US010653246B2

(12) United States Patent
Wu

(10) Patent No.: US 10,653,246 B2
(45) Date of Patent: May 19, 2020

(54) DUAL-USE FOOTREST

(71) Applicant: CHEN-SOURCE INC., Taoyuan (TW)

(72) Inventor: Kuan-Yen Wu, Taoyuan (TW)

(73) Assignee: CHEN-SOURCE INC., Guishan District, Taoyuan (TW)

( * ) Notice: Subject to any disclaimer, the term of this patent is extended or adjusted under 35 U.S.C. 154(b) by 7 days.

(21) Appl. No.: 16/048,908

(22) Filed: Jul. 30, 2018

(65) Prior Publication Data

US 2020/0029698 A1 Jan. 30, 2020

(51) Int. Cl.
*A47C 12/02* (2006.01)
*A47C 16/02* (2006.01)

(52) U.S. Cl.
CPC ..... *A47C 16/025* (2013.01); *A47C 12/02* (2013.01)

(58) Field of Classification Search
CPC ..... A47C 16/025; A47C 16/02; A47C 12/02
USPC ..... 297/423.46, 44, 39, 41
See application file for complete search history.

(56) References Cited

U.S. PATENT DOCUMENTS 3,065,992 A * 11/1962 Nagel ..... A47C 16/025 297/423.46
6,076,893 A * 6/2000 Brotherston ..... A61G 5/12 297/423.25
2007/0222261 A1* 9/2007 True ..... A47C 3/16 297/188.1
2010/0133890 A1* 6/2010 Port ..... A47C 16/025 297/423.46

* cited by examiner

*Primary Examiner* — Mark R Wendell
(74) *Attorney, Agent, or Firm* — Muncy, Geissler, Olds & Lowe, P.C.

(57) ABSTRACT

A dual-use footrest is disclosed. The dual-use footrest comprises a bottom frame and a flip frame. The bottom frame includes a shaft part disposed at a side of the two side plates, and a support disposed a side of the shaft part, and the flip frame includes a shaft coupling part disposed at a side of the two side frames and pivotally connected to the shaft part, and a pedal part disposed on a side of the shaft coupling part. When the back surface of the flip frame is abutted on the bottom frame, the user with the sitting posture can step on the pedal part; and, when the flip frame is outwardly flipped about the shaft coupling part and the shaft part, to abut on the support of the bottom frame by the top surface thereof, the user with the standing posture can step on the footrest.

7 Claims, 5 Drawing Sheets

DUAL-USE FOOTREST

BACKGROUND OF THE INVENTION

1. Field of the Invention

The present invention relates to a dual-use footrest, more particularly to a footrest including a bottom frame, and a flip frame pivotally connected to the bottom frame, and the flip frame can be abutted on the bottom frame by a back surface thereof, for a user with the sitting posture to step thereon, and the flip frame can also be flipped outwardly to abut on the bottom frame by a top surface thereof, an included angle can be formed between the flip frame and bottom frame, so as to provide a user with the standing posture to step on the footrest; as a result, the footrest can have multiple functions for satisfying the requirement for the user with different posture.

2. Description of the Related Art

Modern person spends a lot of time to use desk and chair in office, home life, school, or workstation, but sitting on the chair for a long time will cause pain in the back and neck, and also easily lead to soreness and tension in the legs and back muscles, so that person sitting for a long time may feel tired and have reductions in heart rate, metabolic rate, insulin availability, and high-quality cholesterol, and these problems may cause a significant increase in cardiovascular disease, depression, and diabetes. Some of above-mentioned health problems is because that the sitter's feet are not stably supported, and it results in poor posture and poor blood circulation. For this reason, some manufacturers produce footrests which can be placed on the floor so that the user can step on the footrests for raising legs, thereby promoting blood circulation in the legs and also banishing the soreness and tightness of the muscles.

Furthermore, in recent years, in order to reduce the risk of obesity, solve metabolic problems and prevent cardiovascular diseases, there is a boom in standing to work, so as to improve health, and work efficiency and productivity. As a result, more work places provide the user to stand for working. However, conventional footrest can only be used by a user in the sitting posture, and when the user changes to the standing posture, the conventional footrest cannot provide the user to step thereon. The conventional footrests cannot be used for different postures, so the user must purchase a variety of types of footrests, but multiple footrests takes up a lot of space and are inconvenient to use.

SUMMARY OF THE INVENTION

In order to solve the conventional problems, the inventor develops a dual-use footrest according to the collected data, multiple tests and modifications, and years of experience in industry.

An objective of the present invention is that a bottom frame of the footrest includes a shaft part disposed at a side of the two side plates thereof, and the shaft part includes a support disposed on a side thereof, and a flip frame of the footrest includes a shaft coupling part disposed at a side of the two side frames and pivotally connected to the shaft part, the shaft coupling part includes a pedal part disposed at a side thereof, and when the flip frame is abutted on the bottom frame by a back surface thereof, the flip frame is at a first position, a user with a sitting posture can step on the flip frame, and when the flip frame is flipped outwardly about the shaft coupling part and the shaft part, and the top surface of the flip frame is abutted on the support of the bottom frame, the flip frame is at a second position, and an included angle can be formed between the bottom frame and the flip frame, so that the user with a standing posture can step on the flip frame. As a result, the flip frame can be flipped according to the sitting posture or the standing posture of the user, to meet the requirement in usage height for the sitting posture and the standing posture, thereby satisfying the user with different posture. As a result, the footrest of the present invention can be a multipurpose tool to improve convenience in use.

Another objective of the present invention is that the bottom surface of each of the two side plates of the bottom frame is an arch-shaped curve surface, and when the user with sitting posture uses the footrest, the bottom frame can be swung along the curve surfaces of the two side plates, so that the user can adjust the swing angle of the bottom frame according to the comfort of the foot thereof, and can rotate the ankle thereof appropriately for stretching foot.

Another objective of the present invention is that the pedal part of the flip frame includes a plurality of rods disposed and linked between the two side frames and arranged in interval, so that the intensity of whole structure of the flip frame can be improved by the plurality of rods, and the user can also step on the plurality of rods. As a result, with configuration of the plurality of rods, the pedal part can have multi-purpose of improving the structural strength of the pedal part and providing a user to step thereon.

DETAILED DESCRIPTION OF THE PREFERRED EMBODIMENTS

Figure 1:
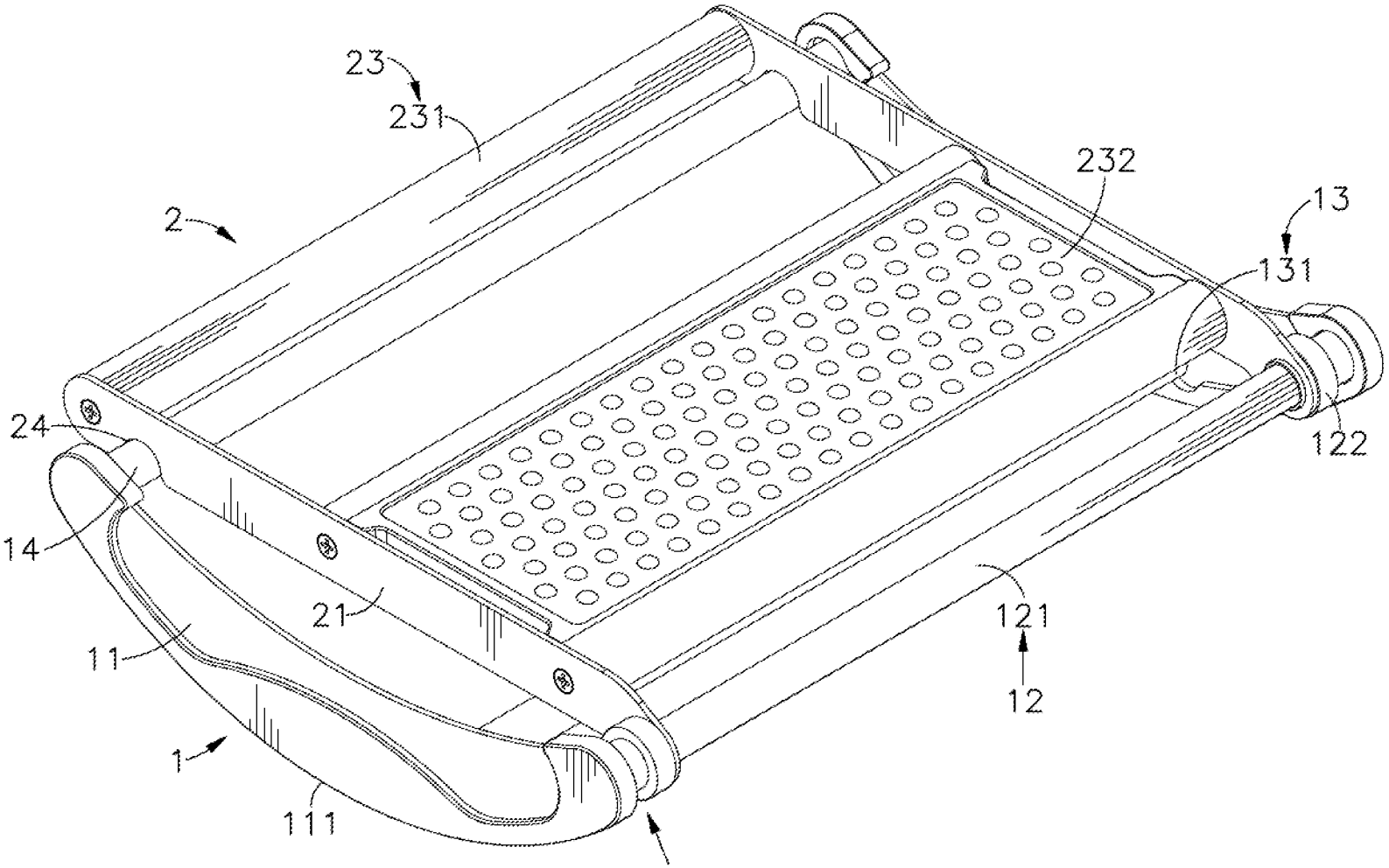
FIG. 1 is an elevational view of a footrest of the present invention.
Figure 2:
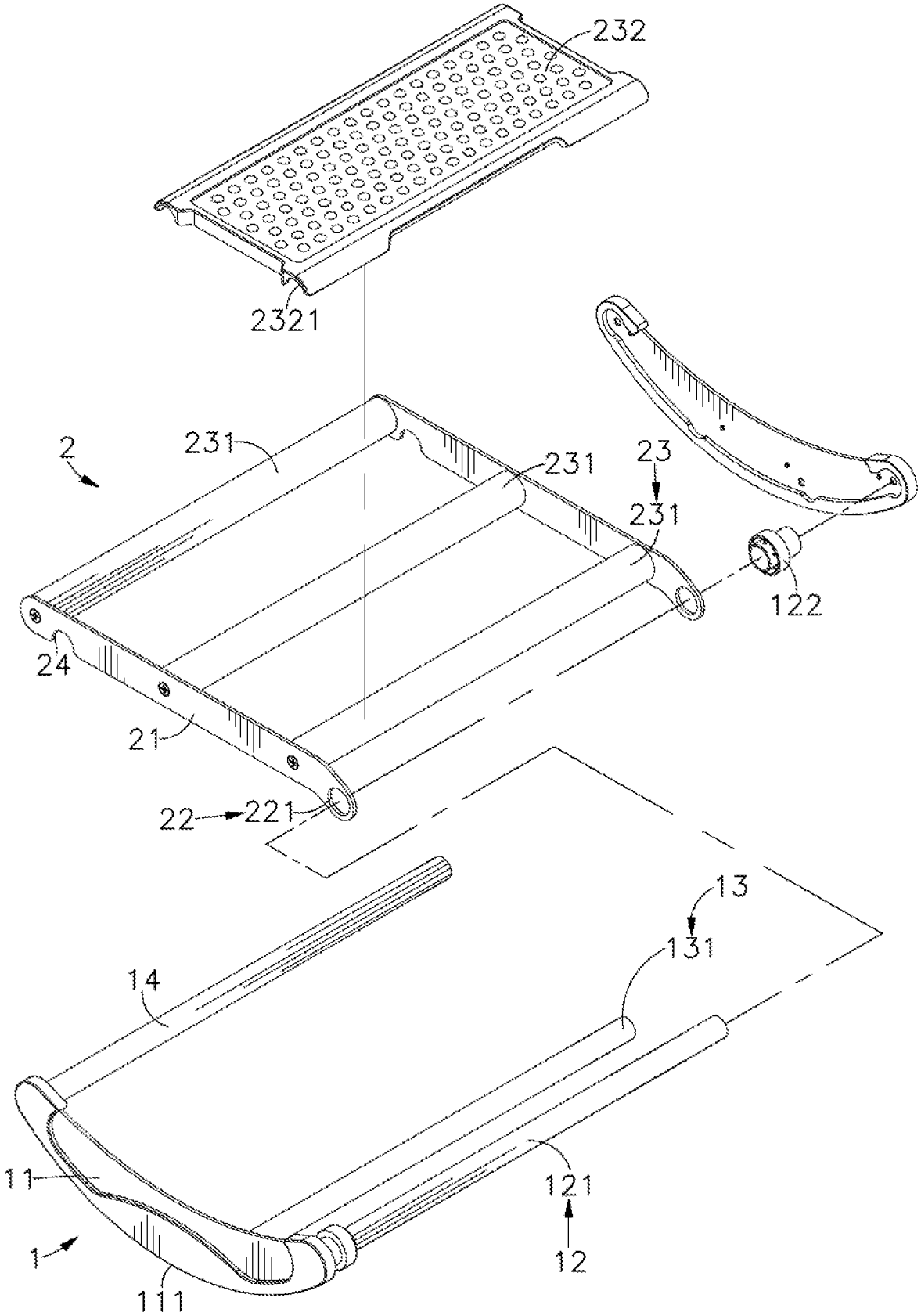
FIG. 2 is an exploded view of a footrest of the present invention.
Figure 3:
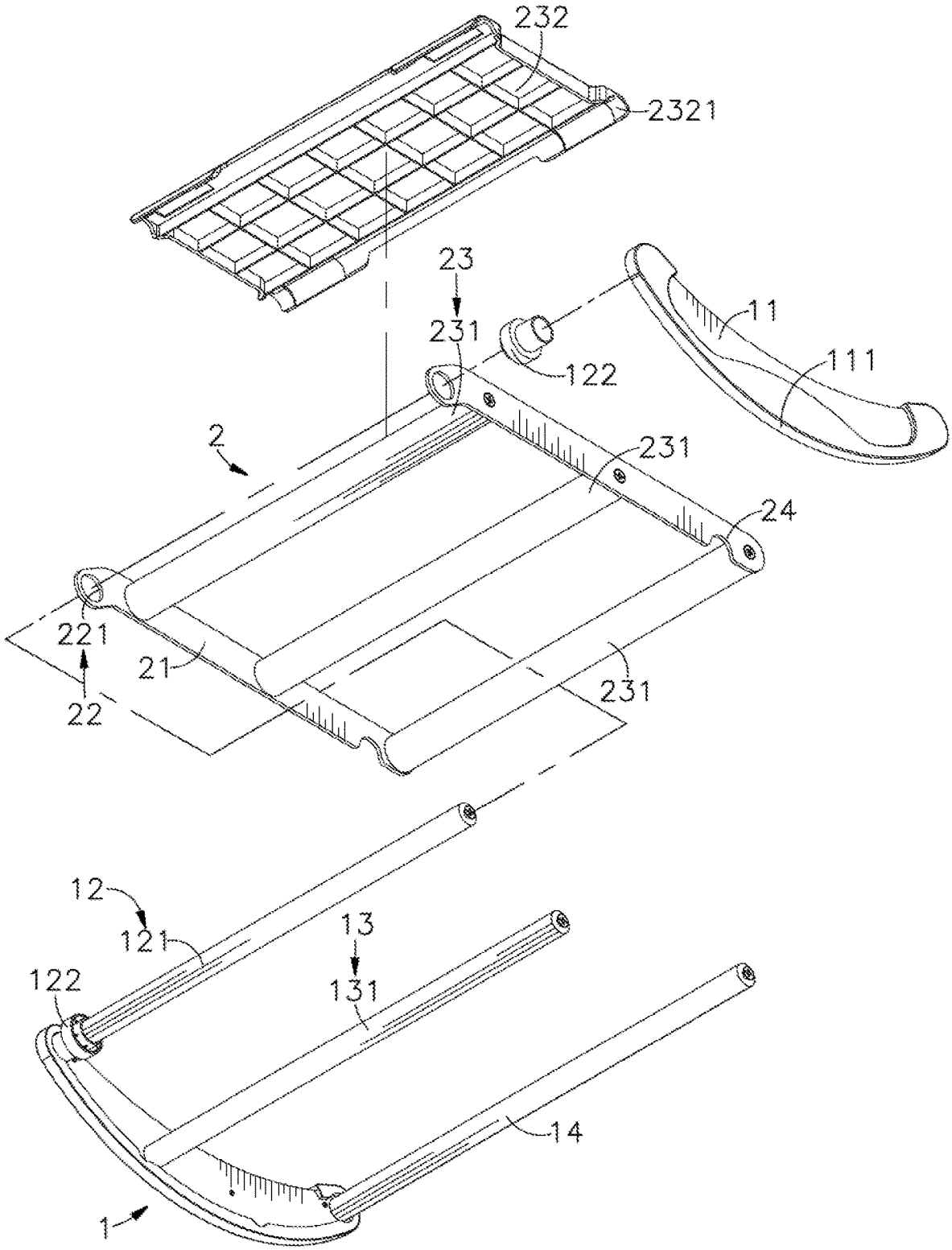
FIG. 3 is an exploded view of a footrest of the present invention, when viewed from another angle.

Please refer to FIGS. 1 to 3, which are elevational view, exploded view, and exploded view when viewed from another angle, of the footrest according to an embodiment of the present invention. As shown in FIGS. 1 to 3, the footrest comprises a bottom frame 1 and a flip frame 2. The bottom frame 1 comprise two side plates 11 arranged in interval, and the bottom surfaces of the two side plates 11 are arch-shaped curve surfaces 111, and a shaft part 12 is disposed at a side of the two side plates 11, and comprises a shaft 121 pivotally connected to the two side plates 11. The shaft part 12 also include the bushings 122 mounted on the shaft 121, disposed on the relatively-inner sides of the two side plates 11, and spaced apart from each other by a distance. The bottom frame 1 includes a support 13 disposed between the two side plates 11 and at a side of the shaft part 12, and the support 13 comprises a support rod 131 pivotally connected to the two side plates 11. The bottom frame 1 further includes a combining rod 14 disposed and linked between other side of the side plates 11.

The flip frame 2 comprises two side frames 21 arranged in interval, and a shaft coupling part 22 disposed at a side of the two side frames 21 and pivotally connected to the shaft part 12. The shaft coupling part 22 comprises two shaft holes 221 formed at and cut through ends of the two side frames 21, respectively, and the two shaft holes 221 are configured to pivotally connect to the shaft 121, and the two bushings 122 can be inserted into the two shaft holes for positioning. The flip frame 2 includes a pedal part 23 disposed between the two side frames 21 and at a side of the shaft coupling part 22 and including a plurality of rods 231 disposed and linked between the two side frames 21 and arranged in interval. The pedal part 23 includes a pedal 232 disposed on the adjacent two of the rods 231, and the pedal 232 is formed with fastening grooves 2321 formed on two opposite sides of a bottom surface thereof and configured to fasten with the plurality of rods 231. The two side frame 21 is formed with engagement grooves 24 recessed on the bottom surfaces of other sides thereof, respectively, and configured to fasten with the combining rod 14.

Figure 4:
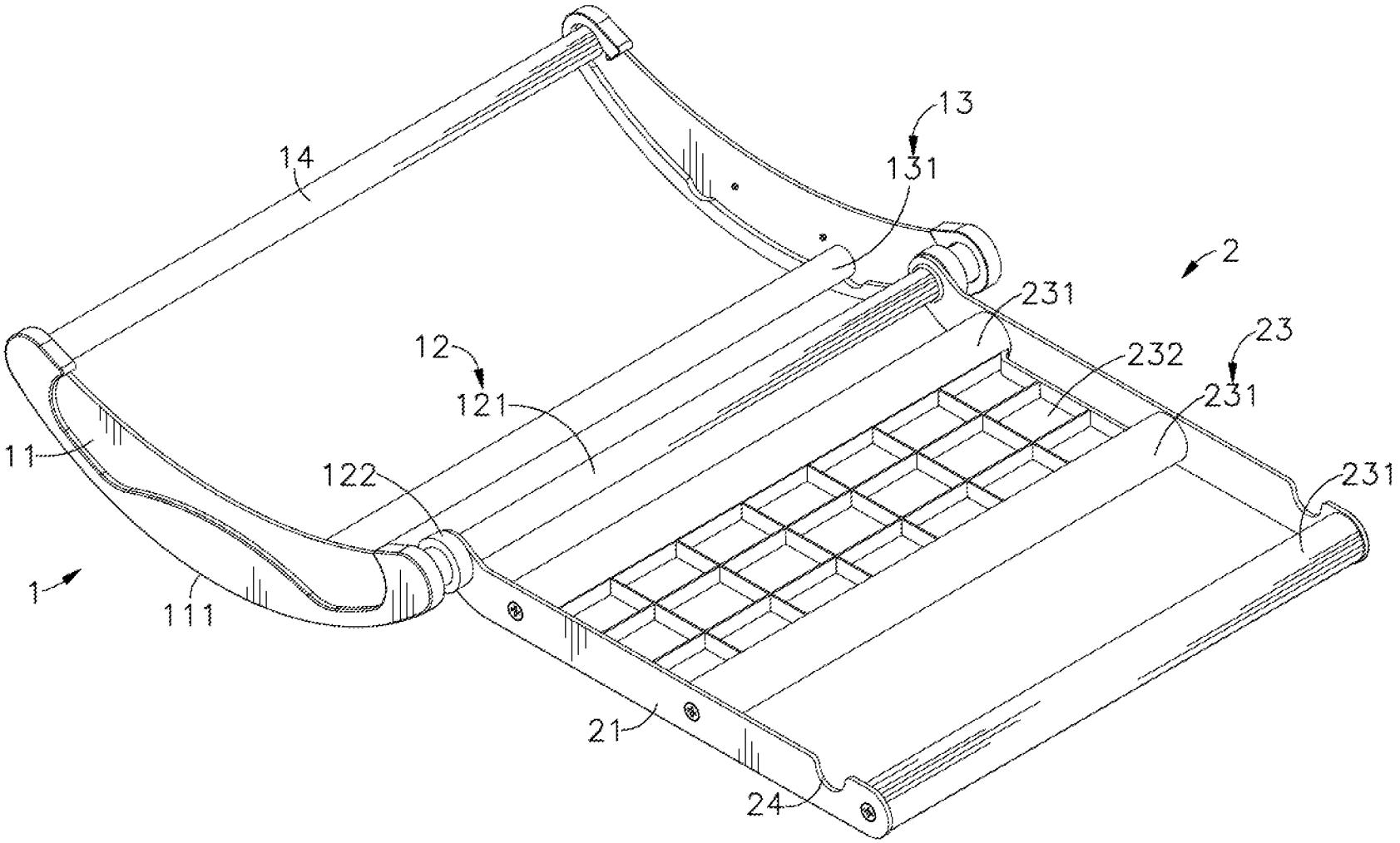
FIG. 4 is an elevational view of a flip frame of a footrest of the present invention, when the flip frame is being flipped.
Figure 5:
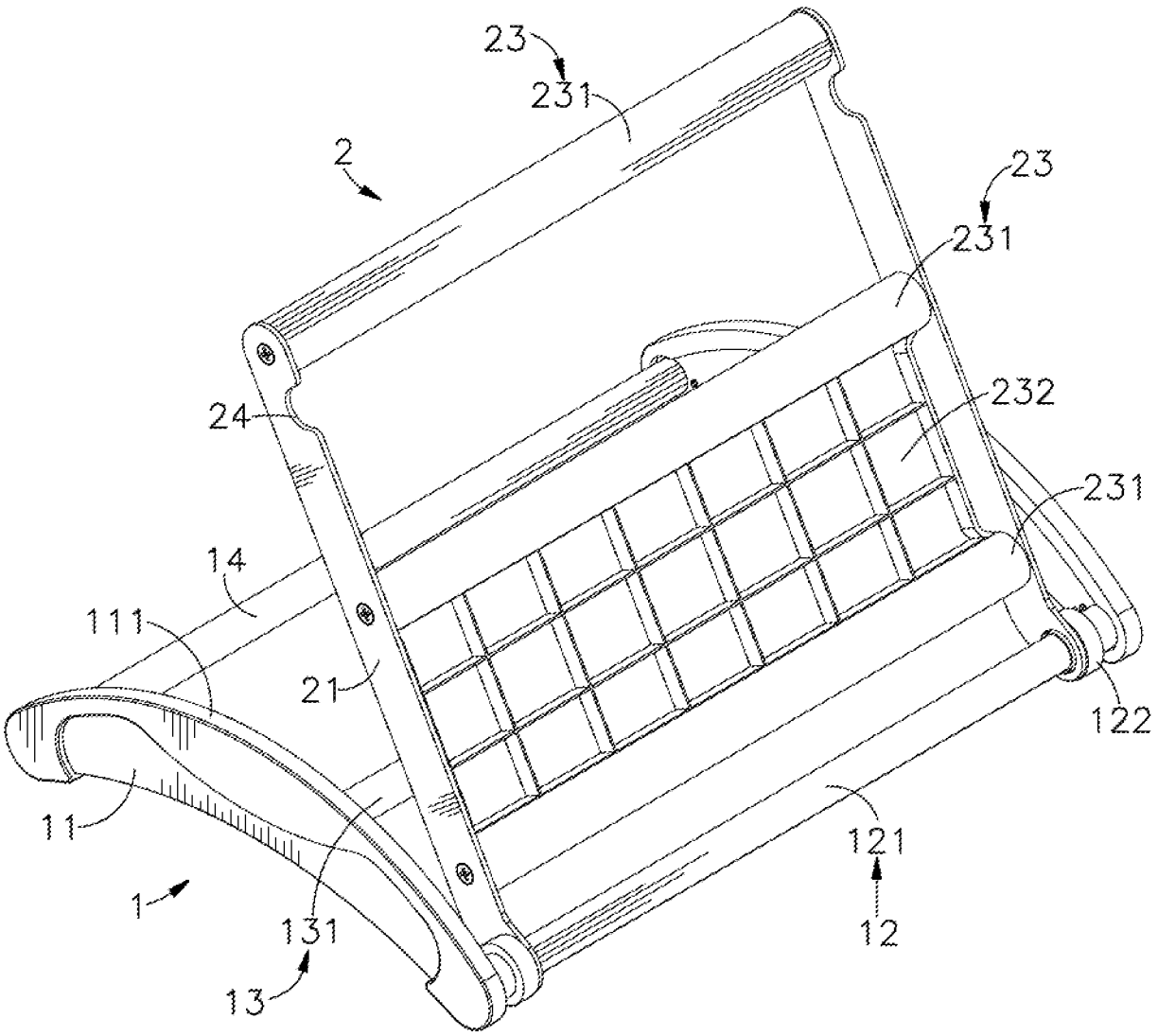
FIG. 5 is an elevational view of a flip frame of a footrest of the present invention, after the flip frame is flipped.

Please refer to FIGS. 1, 4 and 5, which are elevational view, elevational view of flip frame being flipped, and elevational view of the flip frame flipped already, according to an embodiment of the present invention. When a user with sitting posture uses the footrest of the present invention, the flip frame 2 can be a flatly placed and the back surface of the flip frame 2 is abutted on the bottom frame 1, and the plurality of engagement grooves 24 of the flip frame 2 can be fastened with the combining rod 14 of the bottom frame 1 to form stable positioning, at this time, the flip frame 2 is at the first position, as shown in FIG. 1, and the user can step on the pedal 232 of the pedal part 23 of the flip frame 2 by single foot or feet, so as to prevent the user's pelvis from being pressured because of the angle of the leg is excessively low, thereby promoting blood circulation of leg. When the user steps on the pedal 232, the bottom surfaces of the two side plates 11 are arch-shaped curve surfaces 111, so the user can swing the bottom frame 1 along the curve surfaces 111; as a result, the user can adjust the swing angle of the bottom frame 1 according to the comfort of the foot thereof, and rotate the ankle thereof appropriately for stretching foot.

For the user with the standing posture to use the footrest of the present invention, the user can outwardly flip the flip frame 2 about the shaft coupling part 22, to separate the plurality of engagement grooves 24 of the flip frame 2 from the combining rod 14 of the bottom frame 1, and the two bushings 122 of the shaft part 12 of the bottom frame 1 can be driven to rotate on the shaft 121 through the two shaft holes 221 of the shaft coupling part 22, so that the flip frame 2 can be relative-outwardly flipped to the back side of the bottom frame 1; and, the bottom frame 1 is flipped by 180° in a vertical direction, and the curve surfaces 111 of the two side plates 11 of the bottom frame 1 can face upwardly, so that the two side plate 11 of the bottom frame 1 can be placed stably on the ground without shaking or swinging. At the same time, the top surface of the flip frame 2 can be abutted on the support rod 131 of the support 13 of the bottom frame 1, and an included angle can be formed between the bottom frame 1 and the flip frame 2, so that the flip frame 2 is at the second position, as shown in FIG. 5. The user can lift up and then place the foot thereof on the appropriate rod 231 of the pedal part 23 according to comfort of the foot thereof, to stretch the foot and promote blood circulation. As a result, the footrest can be flipped to change the posture thereof according to the sitting posture or the standing posture of the user, and can match the usage height for the sitting posture and the standing posture, thereby satisfying the requirement for the user's different postures.

When the flip frame 2 is disposed on the second position, the included angle between the flip frame 2 and the bottom frame 1 is in a range of 0° to 90°; preferably, the included angle can be 60°, so that the user can have most comfortable bending angle of the ankle.

According to above contents, the footrest of the present invention has advantages below.

First, when the flip frame 2 is at the first position, the back surface of the flip frame 2 is abutted on the bottom frame 1, so that the user with sitting posture can step on the footrest, and after the flip frame 2 is outwardly flipped about the shaft coupling part 22 and the shaft part 12, the top surface of the flip frame 2 can be abutted on the support 13 of the bottom frame 1, the flip frame 2 is at the second position, and the included angle can be formed between the bottom frame 1 and the flip frame 2, so that the user with the standing posture can step on the footrest. As a result, the footrest can be flipped according to the sitting posture or the standing posture of the user, to change the posture of the flip frame 2 between the first position and the second position, so as to meet the requirement in the usage height for the sitting posture and the standing posture, thereby satisfying the requirement for different postures of the user; as a result, the footrest of the present invention can be a multipurpose tool to improve convenience in use.

Secondly, the bottom surface of each of the two side plates 11 of the bottom frame 1 can be the arch-shaped curve surface 111, and when the user with sitting posture uses the footrest, the bottom frame 1 can be swung along the curve surfaces 111 of the two side plates 11, so that the user can adjust the swing angle of the bottom frame 1 according to the comfort of the foot thereof, and further rotate the ankle thereof appropriately for stretching effect.

Thirdly, the pedal part 23 of the flip frame 2 includes the plurality of rods 231 disposed and linked between the two sides of the side frames 21 and arranged in interval, so that the intensity of whole structure of the flip frame 2 can be improved by the plurality of rods 231, and the user can step on the plurality of rods 231; as a result, the plurality of rods 231 of the pedal part 23 can have multi-function and multi-purpose of improving structural strength of the flip frame 2 and providing the user to step thereon.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A dual-use footrest, comprising:

a bottom frame comprising two side plates, a shaft part disposed between a side of the two side plates, and a support disposed between the two side plates and on a side of the shaft part; and a flip frame comprising two side frames, a shaft coupling part disposed between a side of the two side frames and pivotally connected to the shaft part, and a pedal part disposed between the two side frames and on a side of the shaft coupling part, and when a back surface of the flip frame is abutted on the bottom frame, the flip frame is at a first position, and when the flip frame is outwardly flipped about the shaft coupling part and the shaft part to abut on the support of the bottom frame by a top surface thereof, the flip frame is at a second position and an included angle is formed between the bottom frame and the flip frame;

wherein the bottom frame comprises a combining rod linked to other sides of the two side plates thereof, and each of the side frames of the flip frame is formed with an engagement groove recessed on a bottom surface of other side thereof, and when the flip frame is at the first position, the combining rod is fastened with the plurality of engagement grooves.

2. The dual-use footrest according to claim 1, wherein a bottom surface of each of the two side plates of the bottom frame is an arch-shaped curve surface.

3. The dual-use footrest according to claim 1, wherein the shaft part of the bottom frame comprises a shaft pivotally connected on the two side plates, and two bushings mounted on the shaft and disposed on the relatively-inner sides of the two side plates, respectively, and spaced apart from each other by a distance, and wherein the shaft coupling part of the flip frame comprises two shaft holes cut through ends of the two side frames, respectively, and the shaft is pivotally connected to the two shaft holes, and the two bushings are inserted into the shaft holes for positioning.

4. The dual-use footrest according to claim 1, wherein the support of the bottom frame comprises a support rod pivotally connected to the two side plates and configured to abut with the flip frame.

5. The dual-use footrest according to claim 1, wherein the pedal part of the flip frame comprises a plurality of rods disposed and linked between the two side frames and arranged in interval, and a pedal disposed on the adjacent two of the plurality of rods, and the pedal includes a plurality of fastening grooves formed on two opposite sides of a bottom surface thereof, respectively, and configured to fasten with the plurality of rods.

6. The dual-use footrest according to claim 1, wherein when the flip frame is at the second position, the included angle formed between the flip frame and the bottom frame is in a range of 0° to 90°.

7. The dual-use footrest according to claim 6, wherein the included angle is 60°.

* * * * *